US006883686B2

(12) United States Patent
Langlois et al.

(10) Patent No.: US 6,883,686 B2
(45) Date of Patent: Apr. 26, 2005

(54) PRODUCT STORAGE AND DISPENSING SYSTEM

(75) Inventors: Carl M. Langlois, Port Allen, LA (US); David G. Belanger, Prairieville, LA (US); K. Randall Russ, St. Francisville, LA (US); H. Norman Saurage, III, Baton Rouge, LA (US)

(73) Assignee: Community Coffee Company, L.L.C., Baton Rouge, LA (US)

( * ) Notice: Subject to any disclaimer, the term of this patent is extended or adjusted under 35 U.S.C. 154(b) by 0 days.

(21) Appl. No.: 10/386,845

(22) Filed: Mar. 12, 2003

(65) Prior Publication Data

US 2004/0178232 A1 Sep. 16, 2004

(51) Int. Cl.[7] ..... B65D 83/06

(52) U.S. Cl. ..... 222/152; 222/185.1; 222/189.06; 222/189.09; 222/547

(58) Field of Search ..... 222/53, 152, 180–181.3, 222/189.06, 189.09, 195, 544, 547, 59–561

(56) References Cited

U.S. PATENT DOCUMENTS

| | | | | |
|---|---|---|---|---|
| 2,116,300 | A | 5/1938 | Campos | 221/106 |
| 2,662,664 | A | 12/1953 | Le Vern Decker | 222/23 |
| 3,097,828 | A | 7/1963 | Grün | 259/4 |
| 3,820,687 | A | 6/1974 | Brock | 222/53 |
| 3,976,109 | A | 8/1976 | Bailey | 141/9 |
| 4,191,223 | A | 3/1980 | Bourgeois | 141/18 |
| 4,850,304 | A | 7/1989 | Nicholson | 118/694 |
| 4,936,833 | A | 6/1990 | Sams | 604/232 |
| 4,957,221 | A | 9/1990 | Murray | 222/129 |
| 5,437,393 | A | 8/1995 | Blicher et al. | 222/77 |
| 5,542,583 | A | 8/1996 | Boyer et al. | 222/425 |
| 5,669,528 | A | 9/1997 | Romero et al. | 222/53 |
| 5,871,120 | A | 2/1999 | Romero et al. | 222/53 |
| 5,979,717 | A | 11/1999 | Dalton et al. | 222/532 |
| 6,145,705 | A | 11/2000 | Wallace et al. | 222/162 |
| 6,257,464 | B1 | 7/2001 | Dalton et al. | 222/560 |
| 6,341,715 | B1 | 1/2002 | Semenenko | 222/1 |
| 6,374,875 | B1 | 4/2002 | Schroeder et al. | 141/322 |

FOREIGN PATENT DOCUMENTS

| | | |
|---|---|---|
| WO | WO 96/33128 | 10/1996 |

*Primary Examiner*—J. Casimer Jacyna
(74) *Attorney, Agent, or Firm*—Olson & Hierl, Ltd.

(57) ABSTRACT

As storage and dispensing system for the storage of dispensable products under atmospherically modified conditions and for the dispensing of such products from the system. The system is for use with dispensable products, more particularly for use with roasted whole-bean coffee in any retailing application, to extend shelf life of the product. The invention comprises a storage and dispensing container, a valve for enabling a fluid communication between the container and an atmosphere modification source (vacuum pump, inert gas insertion device or other oxygen depletion mechanism), and a gateway for opening the container to the atmosphere and dispensing the product therefrom. A merchandising unit for storing and dispensing perishables includes a plurality of the above described vacuum storage and dispensing containers.

36 Claims, 11 Drawing Sheets

PRODUCT STORAGE AND DISPENSING SYSTEM

TECHNICAL FIELD OF THE INVENTION

The present invention relates to storage and dispensing systems for the storage of dispensable products under atmospherically modified conditions and for the dispensing of such products from the system.

BACKGROUND OF THE INVENTION

Various stored and dispensed products are adversely affected by moisture, oxygen and otherwise ambient atmospheric conditions. Perishable items, such as bulk pharmaceuticals, industrial and laboratory grade chemicals, and cosmetics, may degrade. Other perishable items, such as food products, may spoil and lose flavor. The preservation of certain food products is accomplished by controlling and minimizing the agents of food spoilage.

Food spoilage may be considered as any tactile, visual, olfactory, or flavor change that the consumer considers to be an unacceptable departure from the food's normal state. Of particular importance are oxygen and moisture, which can degrade some food products in a short period of time. A number of preservation techniques, including canning, dehydration, refrigeration, chemical additives, irradiation, and vacuum packing have been devised to stop the various types of food spoilage. Vacuum packing is a known method of removing oxygen and moisture from an environment where food is to be stored.

Ground coffee is one food product, for example, that is vacuum packed to maintain freshness during its storage and delivery to the consumer. Unfortunately, ground coffee begins to loose freshness the moment the container is opened and the vacuum lost to the surrounding atmosphere, which is normally humid and oxygen rich relative to the coffee. Because whole-bean coffee degrades more slowly than ground coffee, consumers are demanding whole-bean coffee that they can grind in small portions just prior to brewing. However, the delivery of roasted whole-bean coffee to consumers in a retail setting is plagued with difficulties, for whole-bean coffee is susceptible to the same, albeit more gradual, degradation in freshness caused by the permeation of oxygen and moisture that occurs during its storage and delivery to the consumer.

Roasted whole-bean coffee is commonly sold from what is known in the industry as atmospheric storage bins. These storage bins typically allow for the storage of beans therein and for access to the beans by the consumer via a scoop or dispensing mechanism. While the storage bins may allow for an easy access to the beans by the consumer, they unfortunately also allow air and moisture to permeate the beans when the beans are stored therein because the atmosphere within the storage bins is common with the atmosphere existing outside the bins. When exposed to these elements, the roasted coffee beans quickly begin to lose their rich aroma, freshness, and distinctive taste.

Various storage and dispensing systems have been devised that both maintain the freshness of the perishable product stored and readily dispense such product when needed. Such systems typically comprise an air-tight storage container for storing the dispensable product, a dispensing mechanism for dispensing a limited amount of product from the storage container, and a vacuum system connected to the storage container or dispensing mechanism for maintaining a reduced atmospheric pressure within the storage container.

Many of these systems include complicated arrangements which enable an operable interaction between the storage container, dispenser and vacuum system.

For example, many systems include multiple valve arrangements linking the internal pressure of the storage container with both an outside atmosphere and a vacuum source. Operation of these valve arrangements are typically linked via complex cam arrangements with multiple dispensing doors associated with the storage container itself. A multiplicity of valves and doors both increases the cost of production of such storage and dispensing systems and increases the likelihood for the occurrence of malfunctions and leaks from the system.

Another common problem with the prior devices is that their design does not allow for the free flow of product out of the container. This is because the various designs, in their attempts to isolate the atmosphere of the interior of the container, rely on dispensing mechanisms having air-tight portion control chambers or dispensers that allow only a limited amount of product to be dispensed at a time. Unfortunately, devices having portion control dispensers have not been successful with consumers who want to control the amount of product that they dispense and purchase.

Portion control dispensers have the disadvantage of requiring multiple operations of the dispenser if the consumer selects a total volume of product that exceeds that dispensed by the system during a single operation, thus diminishing the system's simplicity and ease of operation. These dispensers thus have the disadvantage of requiring the consumer to operate the dispenser multiple times to fill a bag or other storage container having a volume exceeding that dispensed by the system during a single operation of the system.

When presented with a variety of flavored coffees to purchase, many consumers desire to create their own mixture of coffee beans within a given container, thus adding multiple flavors of coffee from the variety of dispensers to a single container. In creating their own mixtures, consumers thus desire to control the quantity of a given flavored coffee added to their mixture, with the quantity desired of a given flavor often not matching that dispensed during a single operation of a portion control dispenser.

Thus, there is a need for a more simplified storage and dispensing system designed so that stored product is relatively free from interaction with air and humidity and readily dispensed with a minimal occurrences of leaks and malfunction. The system should enable a free flow of product to allow the consumer to decide how much product to dispense. The present invention meets these desires.

SUMMARY OF THE INVENTION

The present invention relates to a storage and dispensing container that allows for modifying the atmosphere within the container to better preserve a product stored within the container. For ease of description, the example of coffee as a product will be used, but any possible dispensable product or other food product can also be used. The atmosphere within the container may be modified by reducing the oxygen content within the container through the use of a vacuum pump or through the introduction of an inert gas. The present invention has the advantage in that it allows for the free flow of the product from the container so that the customer can control the amount of coffee dispensed.

The storage and dispensing container has an air-tight enclosure for the storing of the coffee generally as coffee beans. A dispersing mechanism may be located near a passageway defined at the bottom of the enclosure. The dispersing mechanism evenly distributes coffee beans moving towards the passageway and includes a filter that is in fluid communication with a valve which, in turn, enables a fluid communication with an atmospheric modification source. The passageway allows the coffee to exit the enclosure towards a chute which directs a free flow of coffee out of the container and preferably to the customer.

To control the free flow of the coffee out of the container, a gateway is located between the passageway and the chute that selectively seals the passageway when the gateway is in the closed position. When the gateway is moved to a dispensing or open position, coffee can flow freely from the enclosure through the passageway and chute, and thus out of the container and into a bag or other container to be filled by the customer. The gateway comprises a movable barrier wall defining a solid portion with an opening therein that interacts with the passageway of the enclosure. The barrier wall solid portion and opening can be selectively aligned with the passageway to preclude or allow the flow of coffee coming out of the enclosure through the passageway.

A gasket may be located around the passageway for contact with the barrier wall to seal the enclosure when the gateway is in the closed position while a sweeper assembly may optionally be located proximal to the passageway to move chaff and beans away from the gasket and or the periphery of the passageway. The barrier wall opening of the gateway may also include a scissor edge for interaction with a corresponding scissor edge in the passageway for cutting or shearing beans that may get caught in the gateway during closing operations.

To modify the atmosphere within the enclosure, a valve connects the interior of the enclosure with an atmospheric modification source such as a vacuum pump, an inert gas insertion device or other oxygen depletion mechanism. The atmospheric modification source thus creates an oxygen depleted atmosphere within the interior of the enclosure to preserve the product stored therein. The valve is operably associated with the gateway such that the enclosure and atmospheric modification source are placed in fluid communication with one another when the gateway is in the closed position. Preferably, the valve also disconnects the fluid communication between the atmospheric modification source and the interior of the enclosure during at least the dispensing of the coffee to save energy or gas.

The present invention dispenses product via a "flow-through" type dispensing system, rather than a "portion control" type dispensing system. A flow-through type system allows an uninterrupted flow of product to be dispensed from the enclosure, with the volume of product dispensed during such flow being determined by the operator of the system and the total volume of product stored within the enclosure. A portion control system, however, allows only an interrupted flow of product to dispensed from the system, with the quantity or volume of product dispensed by such flow being determined by the system itself.

A flow-through type dispensing system is desirable because it allows the user to select the volume of product dispensed therefrom, without any limitation in volume being imposed by the system itself (as present in portion control systems). Flow-through systems thus have the advantage of allowing the user to select any volume of material to be dispensed during a single operation of the dispenser, thus promoting simplicity of operation and ease of use. Such a system is thus advantageous for allowing a consumer to fill any size of bag or storage container during a single operation of the dispenser. Flow-through dispensing systems also allow a consumer to dispense any desired quantity of coffee during a single operation of the system when creating customized flavored coffee mixtures within a bag or other container.

DETAILED DESCRIPTION OF THE INVENTION

The present invention generally relates to a storage and dispensing container for use with perishable items, particularly food products, and more particularly for use with roasted whole-bean coffee, to extend the shelf life of the perishable product when stored within the container.

Figure 1:
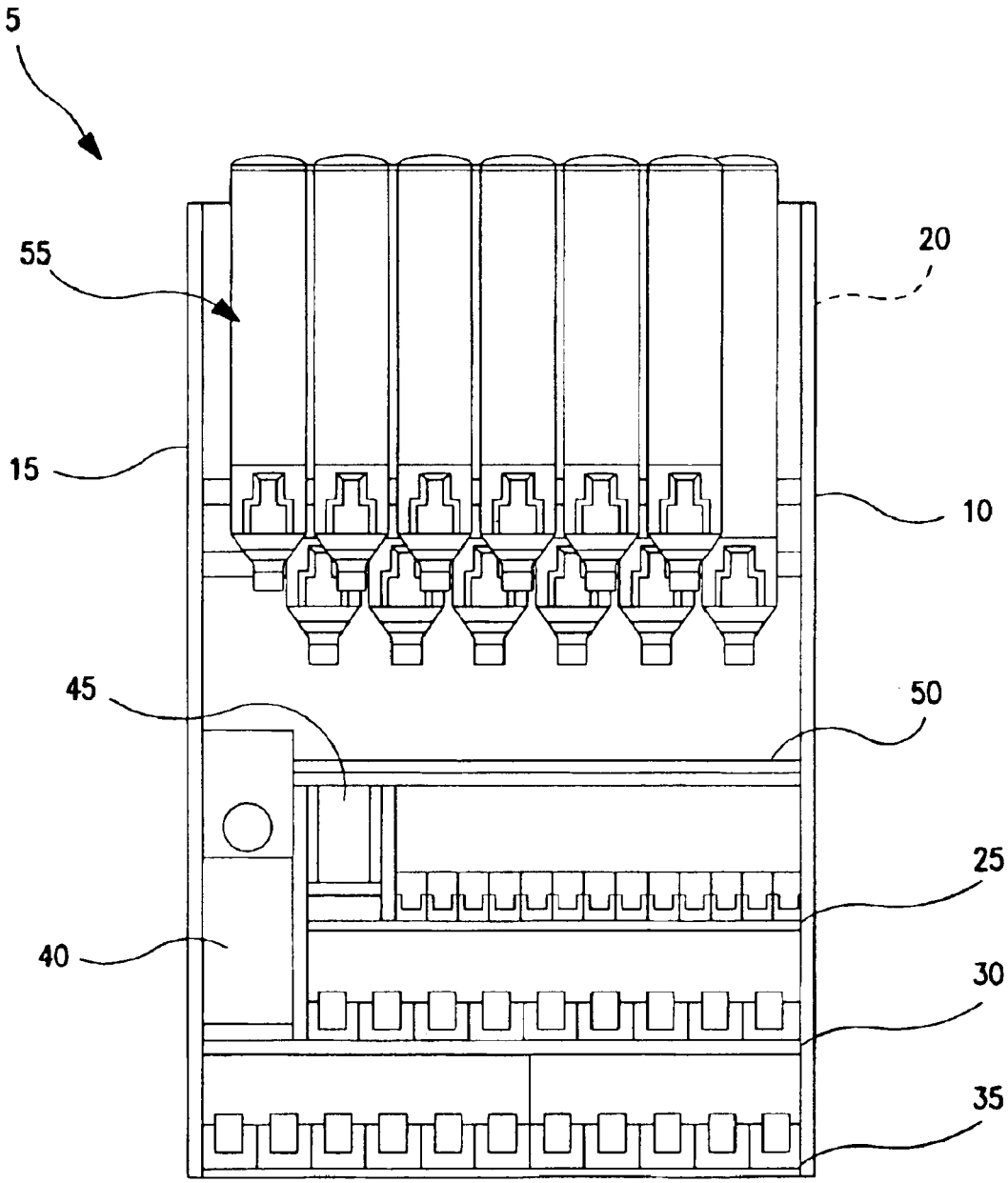
FIG. 1 is a front elevation view of a merchandising unit including a plurality of storage and dispensing containers.

FIG. 1 is a front view illustrating the basic components of one embodiment of the apparatus of the present invention as part of a merchandising unit 5 that can be used by consumers. The merchandising unit 5, which has a right side wall 10, a left side wall 15, and a rear wall 20, may be made of any suitable material. Near the bottom of the merchandising unit 5, there may optionally be provided one or more shelves 25, 30, and 35. Packages of ground and whole-bean coffee may be displayed for sale to the consumer and placed, for example, on top of the shelves 30 and 35. As shown in FIG. 1, shelf 30 may support an optional coffee grinder 40 while shelf 25 supports an optional utility cabinet 45. Coffee grinder 40 is a standard off-the-shelf model that can be used to grind whole coffee beans.

Cabinet 45 may hold empty bags to which the customer may add coffee beans or ground coffee or it may hold a vacuum pump, inert gas insertion device or other oxygen depletion mechanism. A spill tray 50 may be included to catch wayward coffee beans that fail to fall into a bag when released from the containers located above. As illustrated in FIG. 1, near the top of the merchandising unit 5 are one or more storage and dispensing containers 55 filled with roasted whole-bean coffee. Each container 55 may be filled with the same or different type of coffee bean or flavored coffee beans, in enough of a variety to pique the interest of the consumer. Since there is one type of bean per container 55, the products remain separated and can be dispensed separately.

Figure 2:
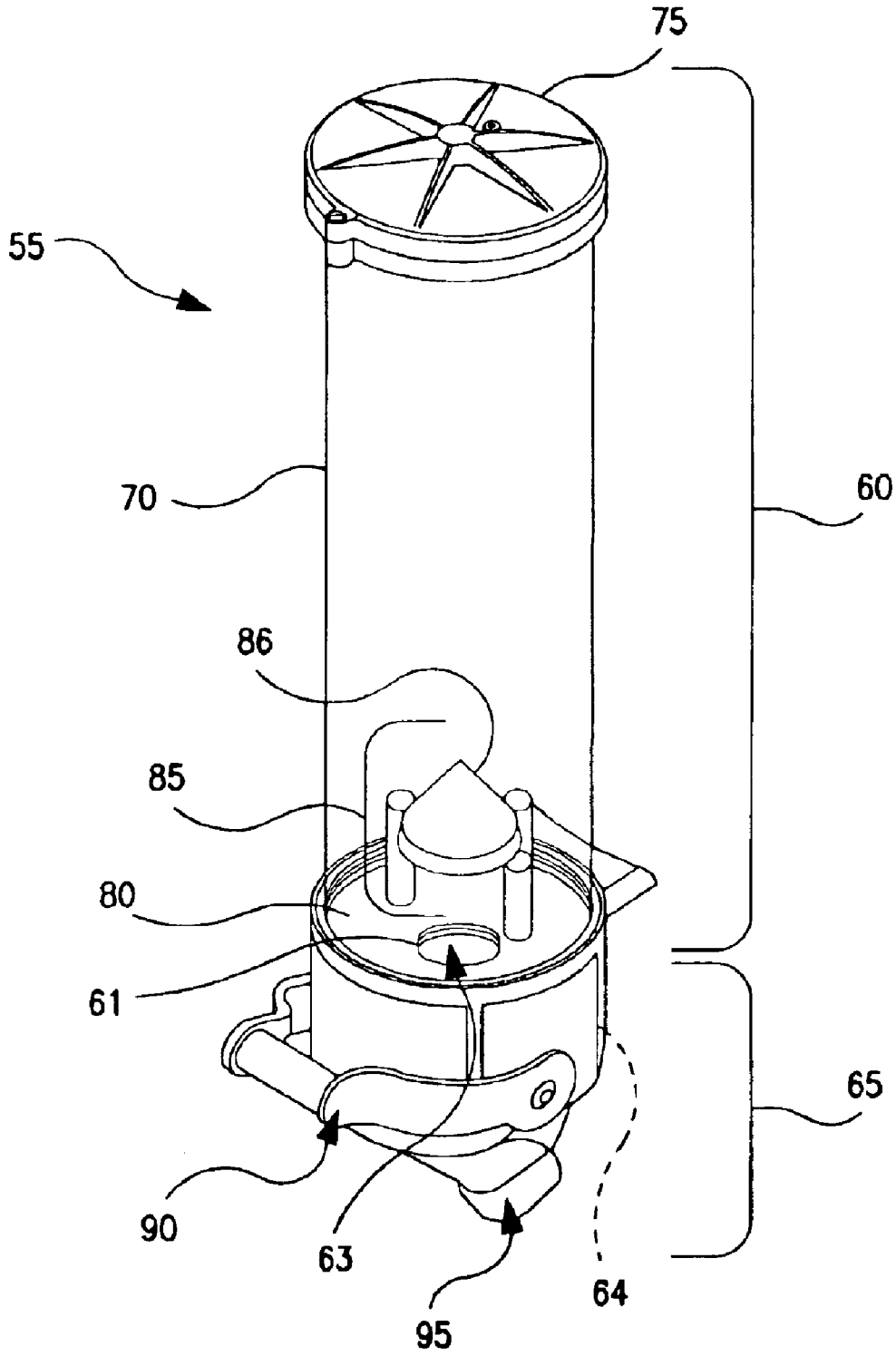
FIG. 2 is a front perspective view of a storage and dispensing container of the merchandising unit of FIG. 1.
Figure 3:
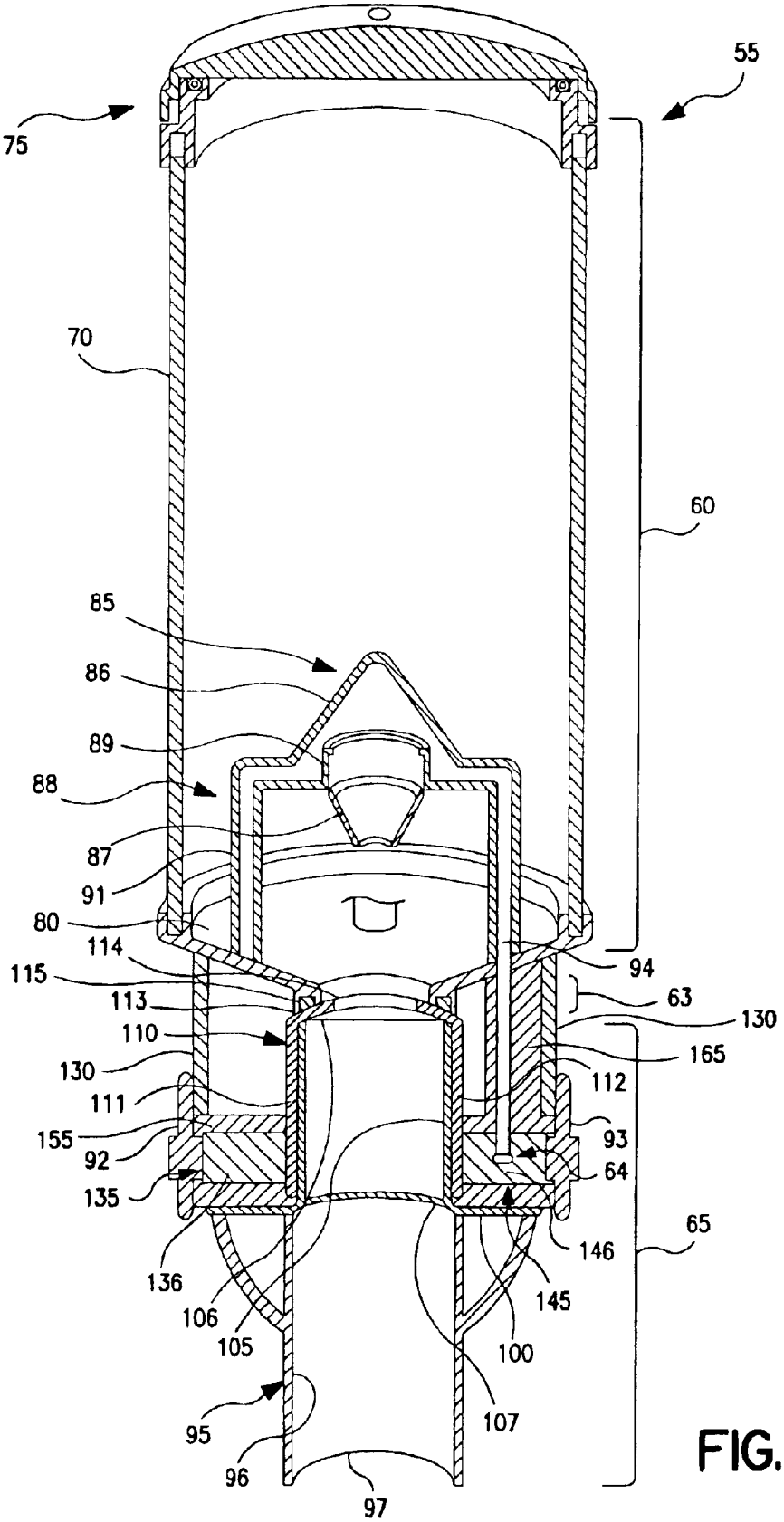
FIG. 3 is a front sectional view of the same container of the merchandising unit of FIG. 2.

FIG. 2 shows a more detailed view of one of the containers 55 of the merchandising unit illustrated in FIG. 1 while FIG. 3 shows a sectional view of the same container 55 forming one embodiment of the present invention. Referring now to both FIGS. 2 and 3, the container 55 stores coffee beans within an air-tight enclosure 60 under atmospherically modified conditions. A dispersing mechanism 85 may be located near a passageway 61 defined at the bottom of the enclosure. The dispersing mechanism 85 evenly distributes coffee beans moving towards the passageway 61 and preferably includes a filter that is in fluid communication with a valve 64 which, in turn, enables a fluid communication with an atmospheric modification source. The passageway 61 is defined at the bottom of the enclosure 60 that allows a free flow of coffee to exit the enclosure 60 towards a chute 65. The chute 65 then directs the flow of coffee coming out of the enclosure 60 through the passageway 61 and ultimately out of the container 55 to the customer. A gateway 63 is located between the passageway 61 and chute 65 to selectively control the free flow of the coffee out from the enclosure 60 through the passageway 61 and out of the container 55 through the chute 65. When the gateway 63 is in the closed position, the coffee is prevented from flowing out of the enclosure 60 through the passageway 61 and the passageway 61 is sealed from ambient atmosphere, thus sealing the enclosure 60 in an air-tight manner.

The valve 64 is associated with the gateway 63 to selectively enable a fluid communication between the interior of the enclosure 60 via the dispersing mechanism 85 and an atmospheric modification source, such as a vacuum pump, inert gas insertion device, or other oxygen depletion mechanism. The atmospheric modification source thus creates an oxygen depleted atmosphere within the interior of the enclosure 60 to maintain the freshness of the stored product. The valve 64 is operably associated with the gateway 63 such that the enclosure 60 and atmospheric modification source are placed in fluid communication with one another when the gateway 63 is in the closed position. The valve 64 also disconnects the fluid communication between the atmospheric modification source and the interior of the enclosure 60 during at least the dispensing of the coffee from the enclosure 60.

The enclosure 60 of container 55 preferably comprises a body 70 having a removable, air-tight lid 75 located at a top end and a skirt 80 defining the passageway 61 located at a bottom end. The dispersing mechanism 85, to be further discussed, is located within the enclosure 60 proximal to the passageway 61 of skirt 80 for evenly distributing the flow of coffee beans that enter passageway 61. The gateway 63 is located below the passageway 61 of skirt 80 and preferably interacts with the passageway 61 via tilt member 110 and gasket 115 to control the flow of coffee through the passageway 61 and into the chute, comprised of a hollow column 105 and a snout 95, which are in fluid communication with one another. The tilt member 110 and gasket 115 of the gateway also seal the passageway 61 of the enclosure 60 when the gateway is in the closed position. Alternatively, the gateway 63 can be an appropriate door or valve mechanism that provides an air-tight seal to the passageway 61 while still allowing for the free flow of coffee. For example, a sliding or hinged barrier, a gate or globe valve, or any similar mechanism as understood in the art can be used to open and close the passageway 61 and to thus seal the enclosure 55 to maintain the freshness of the product stored therein. A control device, such as a manually operated handle 90, is operably connected to the gateway 63 for activating the gateway 63 and valve 64.

Again referring to FIGS. 2 and 3 for a discussion of the construction of the body 70 of the enclosure 60, it is preferred that body 70 be made of a material that is substantially impervious to the variety of flavorings seen in the increasingly popular gourmet coffee products. Furthermore, body 70 is preferably transparent to provide a view of the coffee beans or food items to the purchasing customer. Accordingly, body 70 may be made of different types of material such as tempered glass, polycarbonate, acrylic plastics, or non-acrylic plastics such acrylonitrile butadiene styrene (ABS) plastics.

Body 70 is most conveniently extruded into a seamless tube and is dimensioned according to the desired volume of material to be stored. In one embodiment of the invention, body 70 may comprise a hollow cylinder having a predetermined height and diameter, the dimensions of which are subject to the volume of material to be stored. The inside of the cylinder is preferably smooth to facilitate material flow. While body 70 comprises a hollow cylinder in the preferred embodiment of the invention, body 70 may be of any suitable regular or irregular geometric shape that is capable of holding the product to be dispensed.

The skirt 80 of the enclosure 60 is located below the body 70 and preferably comprises a downwardly directed funnel defining a passageway 61 for directing coffee beans or other dispensable products out of the enclosure 60. As shown in FIGS. 2 and 3, the skirt 80 preferably has a smooth inner surface and is preferably sloped at a predetermined angle to facilitate the flow of dispensable product through the passageway 61. Although skirt 80 is depicted in FIGS. 2 and 3 as a downwardly directed funnel having a round cross section, it is understood that skirt 80 may have an oval, rectangular, square, triangular, or any other geometrical cross section as well. Similarly, although passageway 61 is depicted as being circular in shape, it is understood that passageway can also have an oval, rectangular, square, triangular, or any other shape as well.

Skirt 80 can be fixedly attached to the bottom end of body 70 by any conventional means, to include heat welding, glue, interference fit, or snap-fit. In the preferred embodiment of the invention, skirt 80 is circumscribed by a depending flange forming a groove to receive an insertion of the bottom peripheral end of body 70. In assembly, an elastomeric or similar compound is provided in the groove to both seal and affix to the skirt 80 to the bottom peripheral end of body 70. Regardless of the method of attaching skirt 80 to the body 70, the fit between the two should be air-tight. Although skirt 80 is made out of plastic in the preferred embodiment of the invention, it is understood that skirt 80 may also be made out of wood, metal, or any other material having similar rigidity and air-tight qualities.

The dispersing mechanism 85 illustrated in FIGS. 2 and 3 is located at the bottom of the enclosure 60 above and proximal to the passageway 61. At the top of the dispersing mechanism 85 is an inverted cone 86 defining a hollow interior. Cone 86, having its point directed upwardly and a lower diameter exceeding that of passageway 61, causes the coffee beans located at the center of the enclosure 60 to be diverted to the outer periphery of the enclosure prior to entering dispensing passageway 61 of the skirt 80 for even product rotation. The dispersing mechanism 85 also bears the weight load of the volume of coffee beans stored within enclosure 60, prior to the beans entering passageway 61, to relieve the head pressure of the beans that would otherwise exist against the tilt member, to be discussed further. Although an inverted, hollow cone 86 is used in the dispersing mechanism of the preferred embodiment of the invention, it is understood that a variety of other shapes can be used as well, to include spheres, triangles, ovals, cubes, rectangles, or other non-limiting geometric shapes.

Figure 4:
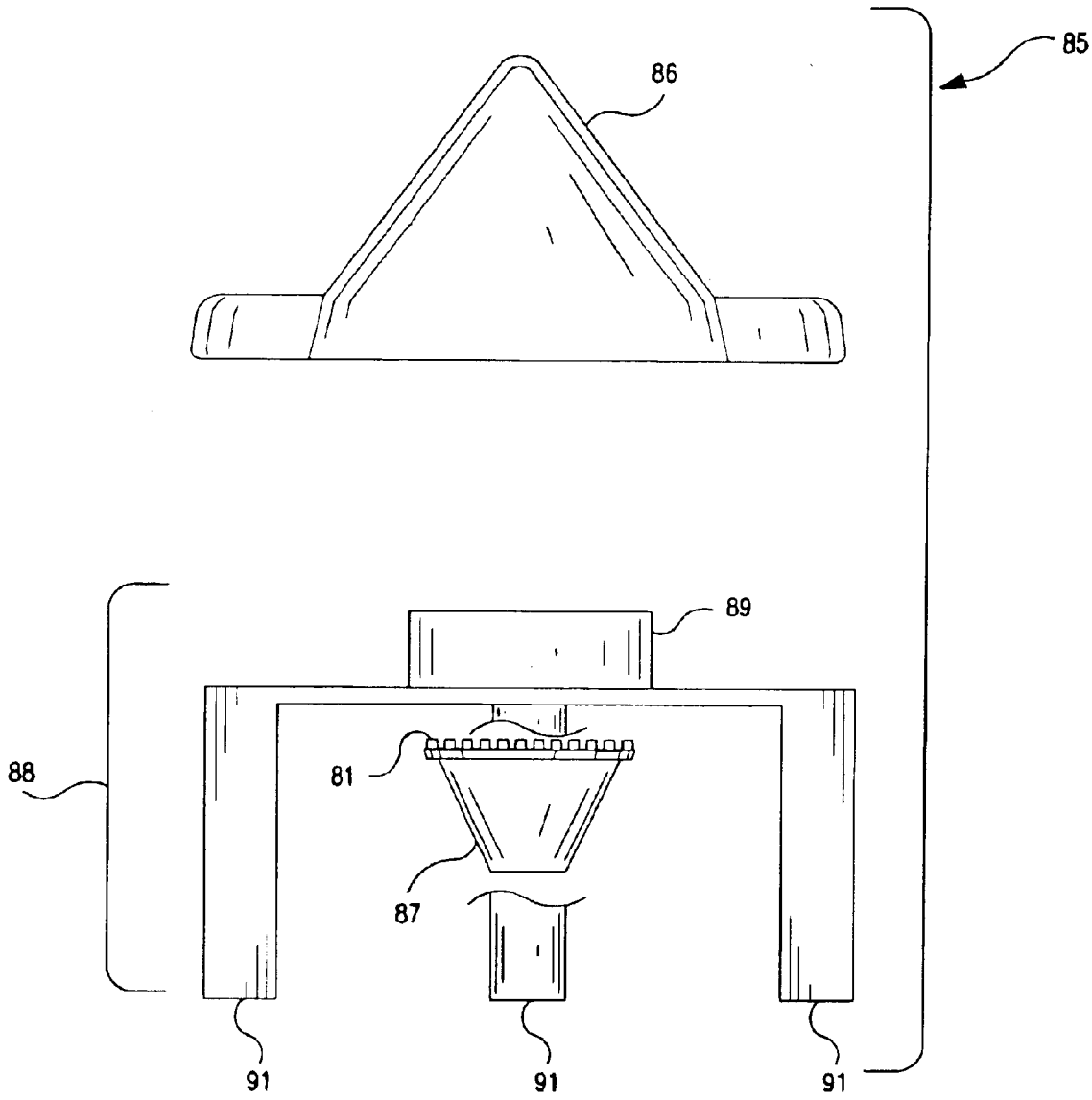
FIG. 4 is a front assembly view of the dispersing mechanism of the container.

FIGS. 3 and 4, show sectional and assembly views, respectively, of dispersing mechanism 85. Dispersing mechanism 85, in addition to having cone 86, also preferably includes a downwardly facing diverting filter 87, with a stanchion assembly 88 located between the cone and filter. Stanchion assembly 88 comprises a hollow apex 89 having three hollow bosses 91 attached thereto. It is understood, however, that stanchion assembly 88 can have one, two or any number of bosses 91 as well.

The hollow apex 89 is preferably upwardly facing and located within the hollow interior of the cone 86. Diverter filter 87, attached to the stanchion assembly 88 below the hollow apex 89 of the mechanism 85, approximates a perforated downwardly facing cone that both diverts product away from the filter and towards the periphery of the enclosure 60 and enables a fluid communication between the interior of the enclosure and an atmospheric modification source. The protrusions 81, preferably attached to the upper periphery of the filter 87, abut the lower end of the stanchion assembly 88, thereby establishing a perforated surface within the filter in fluid communication with the hollow apex 89.

The hollow bosses 91 of the stanchion assembly 88 are attached to the skirt 80 to define at least one hollow 94 socket through the skirt. The at least one hollow socket 94, the bosses 91, the hollow interior of cone 86, and the hollow apex 88 are in fluid communication with one another to establish a fluid communication with the diverter filter 87 of the dispersing mechanism 85, with the diverter filter 87 in fluid communication with the interior of the enclosure 60 via the protrusions 81. The at least one hollow socket 94 of the skirt 80, in turn, is in fluid communication with either a pressure differential mechanism or an inert gas insertion mechanism, to be discussed further.

Through this assembly of components, filter 87 can thus serve as either the fluid inlet for a vacuum pump or a fluid outlet for an inert gas insertion device for modifying the atmosphere within the enclosure 60. Because the diverter filter 87 approximates a downwardly facing cone, with the protrusions 81 establishing the fluid inlet or outlet proximal to the stanchion assembly 88, coffee beans or any other dispensable product located within the enclosure 60 will not interfere with the any fluid flow entering or exiting the enclosure 60 through the filter of the dispersing mechanism 85.

Figure 5:
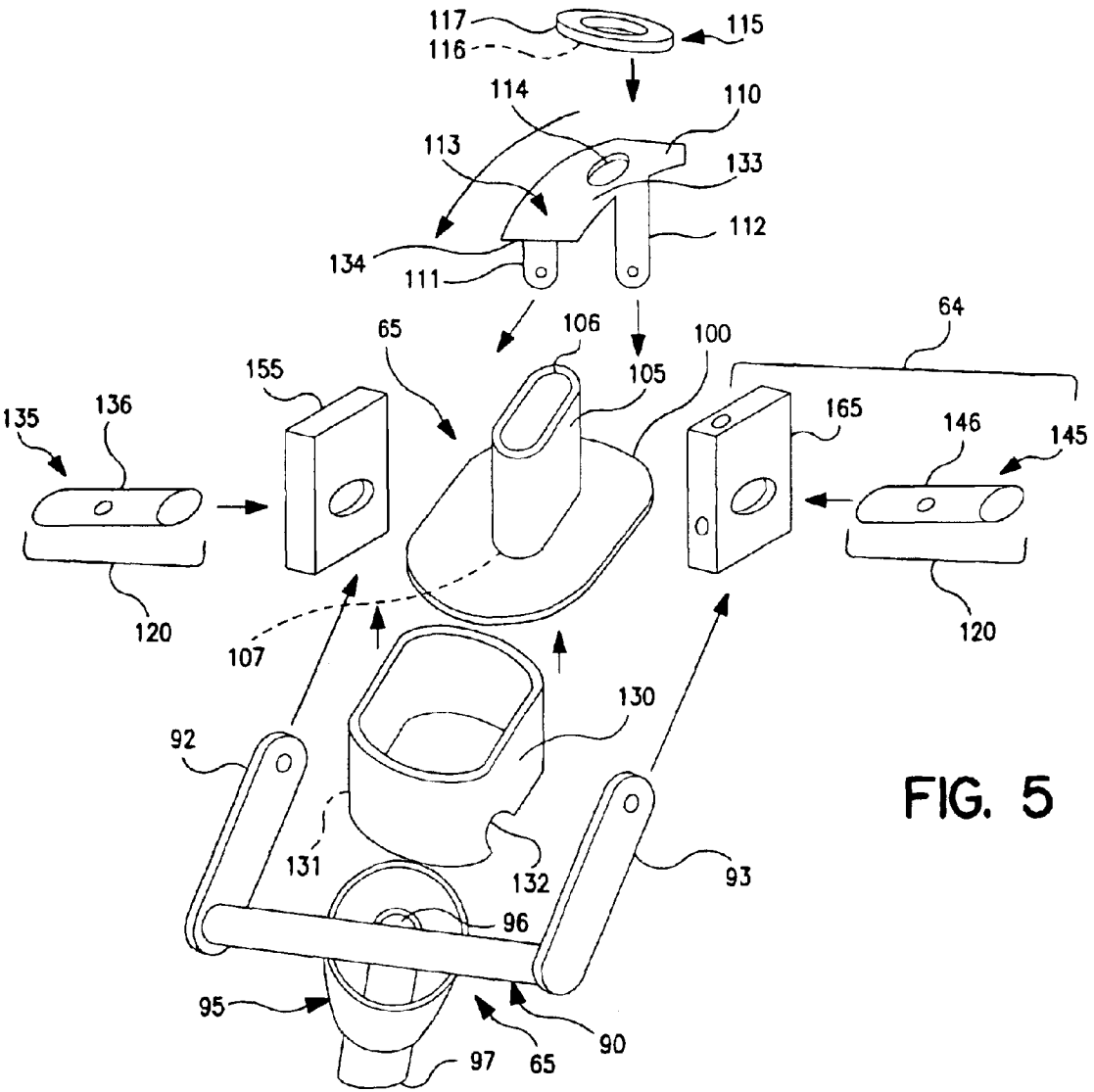
FIG. 5 is an assembly view of the tilt member, skirt, chute, valve and base of the storage and dispensing container.

FIGS. 3 and 5 show the base 100 located below the enclosure 55. Base 100 is the structure to which most of the components of the gateway 63 and chute 65 are mounted to. Although base 100 is made out of plastic in the preferred embodiment of the invention, it is understood that base 100 may also be made out of wood, metal, or any other material having similar rigidity and component-supporting qualities. Base 100 is removably attached to underside of skirt 80 via four upwardly extending, hollow pylons (not shown). Screws, bolts, or other fastening implements may be inserted upwardly through the pylons to threadedly engage the bottom of skirt 80, thereby removably securing the base 100 to skirt 80. It is understood, however, that the base may be removably attached to skirt 80 via other means, to include resistance fit, snap-fit, or other similar fastening methods. It is also understood that base 100 may be fastened directly to the body 70 instead of skirt 80.

Again referring to FIGS. 3 and 5, centrally located within base 100 is the hollow column 105 of chute 65. In the preferred embodiment of the invention, hollow column 105 is integral with base 100. However, it is understood that hollow column 105 may be a component that is separate from base 100 as well. Hollow column 105 is a hollow conduit through which the dispensed product travels after exiting the enclosure 60 through the passageway 61. The top end of the hollow column 105 thus defines a hollow column opening 106 that lies proximal to the passageway 61 while the bottom end of hollow column 105 defines a base opening 107 in the underside of base 100. Hollow column 105 has a cross sectional area approximately oval in shape and having a size that is at least as big as the passageway 61. After exiting the enclosure 60 through passageway 61 and hollow column opening 106, dispensed product travels the length of hollow column 105 and exits the container through base opening 107.

The flow-through design of the present invention and the entry of dispensed product from the enclosure through the passageway 61 into hollow column 105 is preferably controlled by the tilt member 110 of the gateway 63. Referring again to FIGS. 3 and 5, the tilt member 110 is comprised of first and second supports 111 and 112 and a barrier wall 113 defining a solid portion 133 and barrier wall opening 114. Tilt member 110 preferably approximates a hollow, spherical segment in structure, with first and second tilt member supports 111 and 112 comprising parallel, elongated support structures. These tilt member supports 111 and 112 support the tilt member barrier wall 113 having an outer surface resembling a hollow, spherical segment. Within the barrier wall 113 is an opening 114 having a shape and size similar to that of passageway 61.

The location of the solid portion 133 of barrier wall 113 and barrier wall opening 114 in relation to passageway 61 and hollow column opening 106 define the tilt member 110 operation of the gateway 63. The tilt member 110, located between the passageway 61 and hollow column opening 106, is rotatably movable between a fully closed position and a fully open (dispensing) position. When the tilt member 110 is in the fully closed position, the solid portion 133 of barrier wall 113 is aligned with both the passageway 61 and hollow column opening 106, effectively creating a barrier to preclude the dispensable product from flowing out of the enclosure 60 and through the passageway 61. When the tilt member 110 is in the fully open position, the barrier wall opening 114 is aligned with both the passageway 61 and hollow column opening 106, effectively enabling the dispensable product to flow out of the enclosure 60, through the passageway 61 and hollow column opening 106, respectively, through the hollow column 105, and out of the base opening 107. When the tilt member 110 is in a partially open position, a portion of the barrier wall 113 solid portion 133 and at least a portion of the barrier wall opening 114 are both aligned with the passageway 61 to enable a less than optimal flow of dispensable product out of the enclosure 60.

Open and closed stops (not shown) are provided to limit the rotational movement of tilt member 110. The open stop aligns the barrier wall opening 114 with both the passageway 61 and hollow column opening 106 when tilt member 110 is in the fully open position. The closed stop aligns the barrier wall 113 solid portion 133 with both the passageway 61 and hollow column opening 106 when the tilt member is in the fully closed position. It is understood that the position of the barrier wall 113 solid portion 133 and barrier wall opening 114, in relation to both the passageway 61 and the hollow column 106, can fall in any number of locations between the fully open and closed position to define a partially open position that allows a less than optimal flow of product through the passageway 61 and hollow column opening 106. Such partially open positions thus allow the user to control the volumetric flow of product out of the enclosure 60. When the tilt member is in the fully open position, a greater volumetric flow of product out of the enclosure will occur while a reduced volumetric flow of product will occur when the tilt member is in a partially open position.

To help prevent chaff and beans from getting caught between the tilt member barrier wall 113 and the skirt 80 and to ensure that an air-tight seal exists between the two when the tilt member 110 is in a closed position, a gasket 115 is preferably included with the gateway 63 between the gateway tilt member 110 and skirt 80 of the enclosure 60. Referring now to FIGS. 5, 6, 7 and 8, gasket 115 is preferably generally ring-shaped, made of a deformable, elastomeric material, and has a pre-determined thickness to ensure that an interference fit exists between the gasket 115 and barrier wall 113 of tilt member 110. In the preferred embodiment of the gasket 115, the gasket includes at least one inner circumferential ridge 116 and at least one outer circumferential ridge 117, concentrically located in relation to one another, with the at least one outer ridge 117 extending further outwardly than the at least one inner ridge 116 to provide two concentric contacts to the spherical shape of the barrier wall 113. Of course, other non-limiting examples of the gasket 115 include a flat gasket, O-ring, U-cup, V-ring, or other suitable gasket, to form a secure seal between skirt 80 and tilt member barrier wall 113 as well.

The at least one ridges 116 and 117 contact the barrier wall 113 and wipe the face of the barrier wall as it slides past the gasket during tilt member opening and closing operations, thus providing at least a double seal between the tilt member barrier wall 113 and skirt 80. Thus, when the tilt member 110 is in the fully closed position, an interference fit exists between the gasket 115 and barrier wall 113 to create an air-tight seal between the barrier wall and skirt 80. This air-tight seal ensures that the enclosure 60 is maintained in an air-tight state when the tilt member 110 is in the closed position. Furthermore, when the tilt member 110 is in a fully open or partially open position, an interference fit exists between the gasket 115 and barrier wall 113 to ensure that chaff and beans will not get caught between the tilt member barrier wall 113 and the skirt 80.

Figure 6:
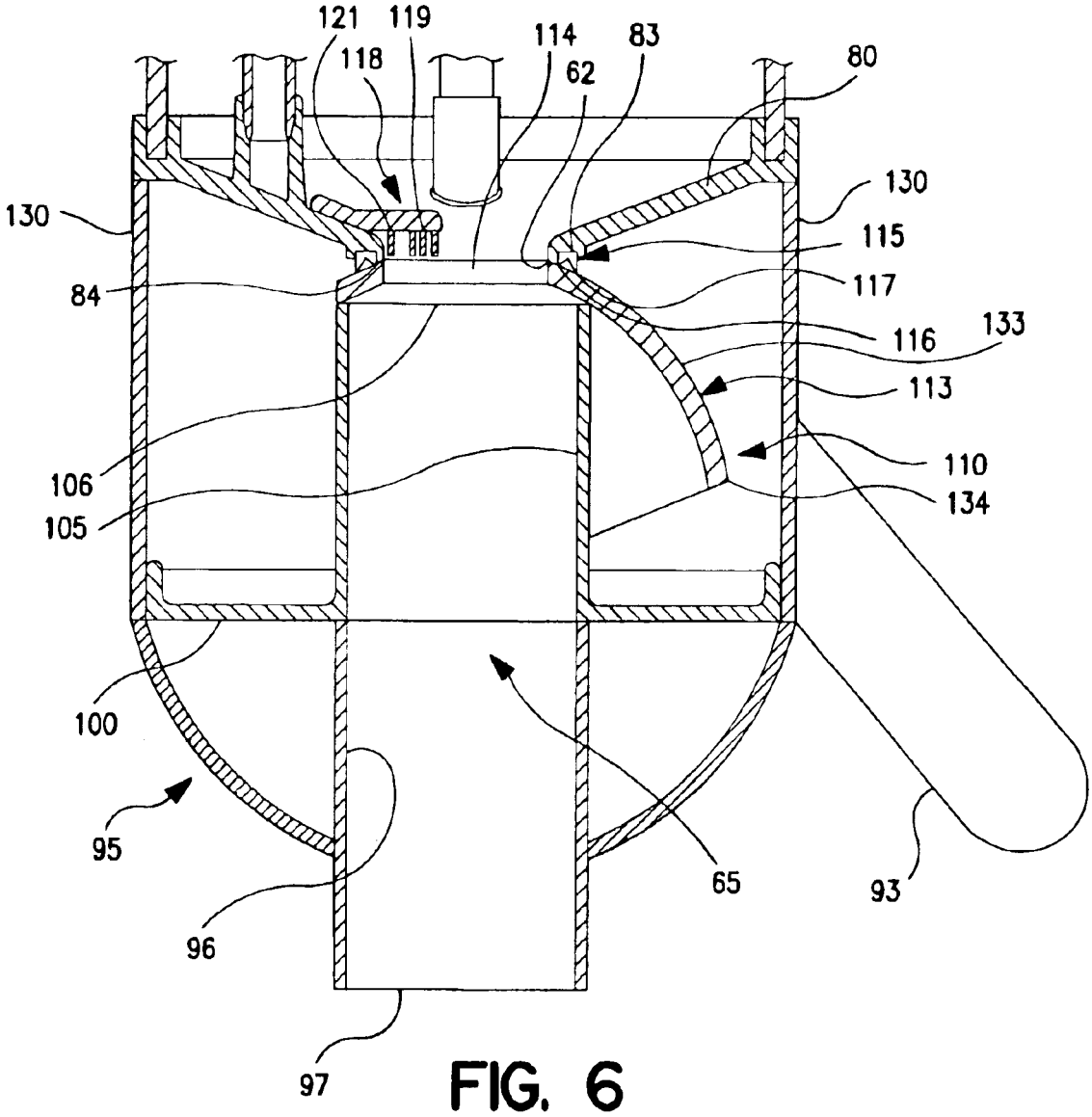
FIG. 6 is a side sectional view of the tilt member, gasket and sweeping assembly with the tilt member in the fully open position.
Figure 7:
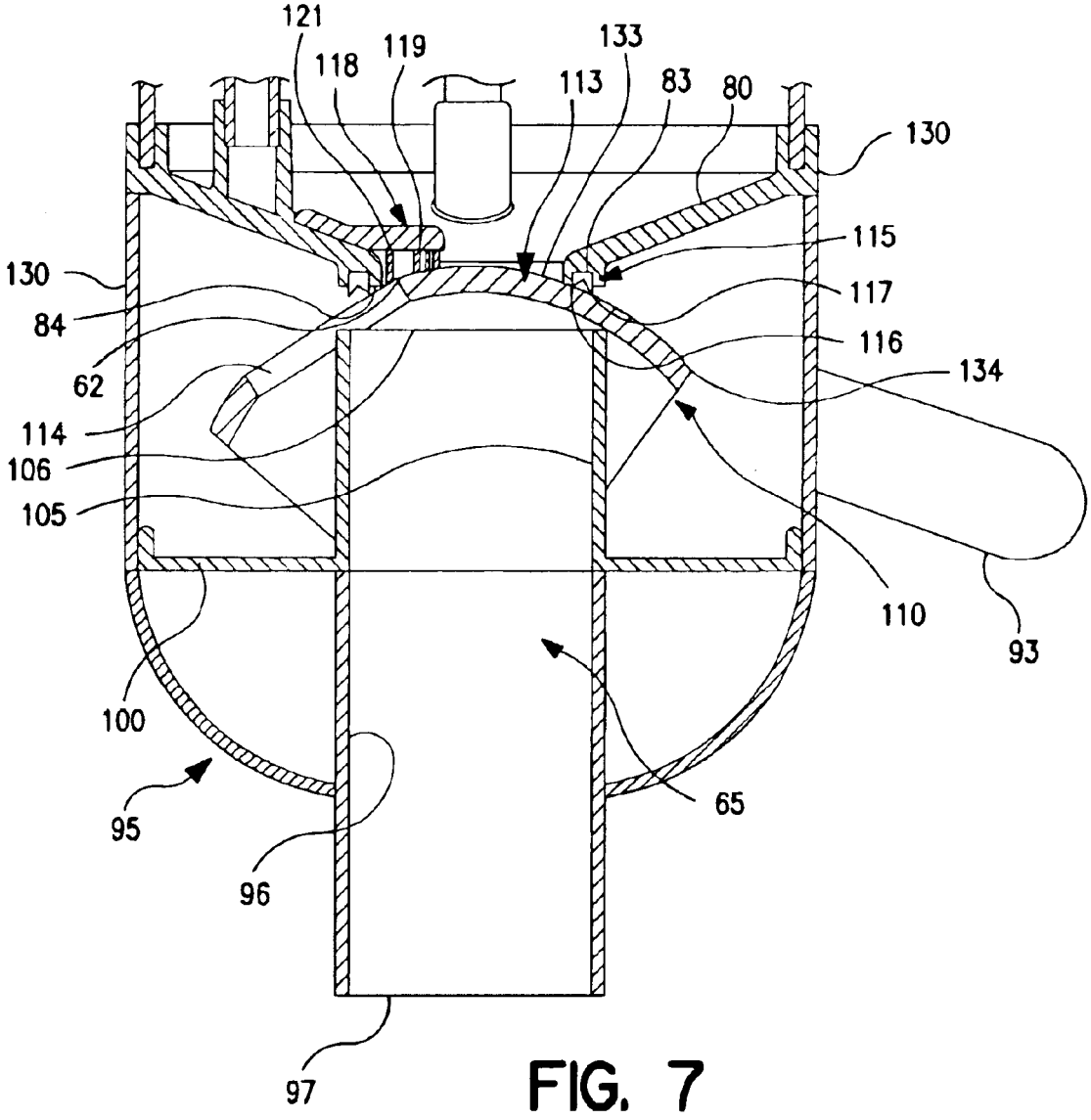
FIG. 7 is a side sectional view of the tilt member, gasket and sweeping assembly with the tilt member in the partially open position.
Figure 8:
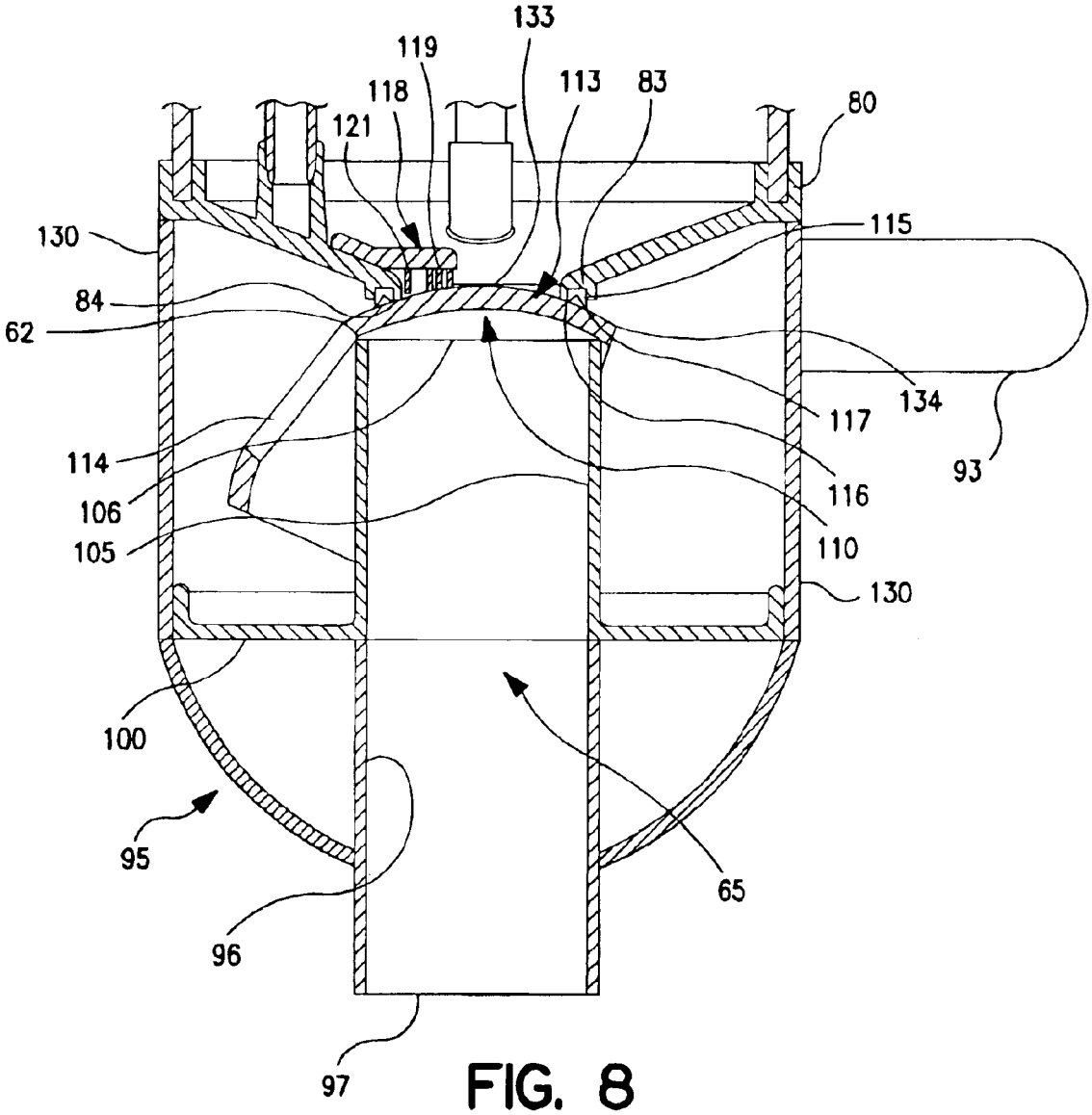
FIG. 8 is a side sectional view of the tilt member, gasket and sweeping assembly with the tilt member in the fully closed position.

FIGS. 6, 7 and 8 illustrate a sectional view of the skirt 80 to show where gasket 115 is attached to the underside of skirt 80 within recessed ring 83. Ring 83 is located concentrically around the periphery of passageway 61. Gasket 115 can be secured therein by adhesive, resistance fit, or similar means. The location of gasket 115 is concentrically offset by a pre-determined distance from the outer periphery of passageway 61. This concentrically offset location of the gasket in relation to the passageway 61 is important due to the interaction of the passageway with the barrier wall opening of the tilt member.

The inner periphery of the passageway 61 and the inner periphery of the barrier wall opening 114 can be beveled to form a peripheral passageway knife edge 84 and a peripheral barrier wall opening knife edge 62, respectively (FIGS. 6, 7 and 8). These knife edges 84 and 62 interact with one another during the closing of tilt member 110 to create scissor or guillotine effect that cuts or shears any coffee bean that is caught between the two edges during the closing operation. The offset location of the gasket 115 in relation to the passageway 61 thus ensures that no interference fit is created between the barrier wall opening knife edge and gasket 115, thus causing damage to gasket 115.

Turning again to FIGS. 6, 7 and 8, the invention may also include a sweeping assembly 118 (not shown in FIGS. 3 and 5 for clarity) located within the passageway 61 of the skirt 80 for directing chaff and beans away from the gasket 115 as the tilt member 110 moves to a closed position. The sweeping assembly 118 also directs chaff and beans away from the inner periphery of the passageway 61 and getting caught between the tilt member barrier wall 113 and the skirt 80. The assembly 118 is preferably made of an elastomeric material and is comprised of at least one sweeping brush 119 and at least one wiping blade 121 that contacts the barrier wall 113 of the tilt member 110 as the barrier wall 113 rotates past the passageway 61 and sweeping assembly during opening and closing operations. Although the sweeping assembly 118 is comprised of at least one sweeping brush 119 and at least one wiping blade 121 in the preferred embodiment of the invention, it is understood that the sweeping assembly 118 may also be comprised of at least one sweeping brush 119 without the wiping blade 121, at least one wiping blade 121 without the sweeping brush, or any number of each component in a combination of both.

The sweeping assembly 118 is preferably located within the passageway 61 proximal to the gasket 115 such that the barrier wall 113 contacts the at least one sweeping brush 119 and then the at least one wiping blade 121, prior to contacting the gasket 115, as the tilt member 110 moves towards its closed position. When the tilt member 110 is in the fully open position, as illustrated in FIG. 6, the at least one sweeping brush 119 and the at least one wiping blade 121 of the assembly 118 are located proximal to the barrier wall opening 114 and are not in contact with the barrier wall 113. As the tilt member 110 moves from the a fully open position towards a fully closed position, the barrier wall opening 114 moves out of proximity with the sweeping assembly 118 and the barrier wall 113 moves into contact therewith, as shown in FIG. 7.

As the barrier wall 113 rotates past the sweeping assembly 118 during the closing operation illustrated in FIG. 8, the at least one sweeping brush 119 sweeps the barrier wall surface to direct any beans or chaff away from the inner periphery of the passageway 61 and or away from the gasket 15. The barrier wall 113, after contacting the sweeping brush 119 of the assembly 118, next moves past the at least one wiping blade 121, which thus wipes the surface of the barrier wall 113 surface of any beans or chaff not swept clear by the brush 119, again directing the any beans or chaff away from the inner periphery of the passageway 61 and or away from the gasket 15. Alternatively, the barrier wall may also contact the at least one wiping blade 121 prior to contacting the at least one sweeping brush 119 as the tilt member moves towards its closed position.

In the preferred embodiment of the invention illustrated in FIGS. 6, 7 and 8, the sweeping assembly 118 is attached to the skirt 80 with adhesive for interaction with the tilt member 110 through the passageway 61. However, it is understood that the assembly 118 could be attached to the dispersing mechanism 85, the body 70, or other components of the container 50 as well. Furthermore, although adhesive is used in the preferred embodiment of the invention to attach the assembly 118 to the skirt 80, it is understood that heat welding, screws, rivets, bolts, snap fit, resistance fit, or other similar attachment methods can be utilized as well.

The operation of the gateway 63 is preferably defined by the rotating movement of the tilt member 110 in relation to the skirt 80. As illustrated in FIGS. 3 and 5, this rotating motion is made possible by the shaft assembly 120. While shaft assembly 120 may be made of any suitably rigid material, it is preferably made of aluminum, polycarbonate, fiberglass-filled polycarbonate, stainless steel, or other metals and materials. Shaft assembly 120 is comprised of first and second shafts 135 and 145, respectively, that are rotatably fastened to the base 100 on opposite sides of the hollow column 105 via respective first and second hinge posts 155 and 165. First and second hinge posts 155 and 165 may be attached to the base 100 with screws, bolts, pop rivets, glue, heat welding, or any other fastening method understood in the art.

First and second hinge posts 155 and 165 are rotatably connected to central portions 136 and 146 of the first and second shafts 135 and 145 of shaft assembly 120. This rotatable connection can be established via any type of rotatable coupling understood by those skilled in the art, to include various types of rotating bearing, bushing, flange and journal, pivot and hinge relationships. Because first and second hinge posts 155 and 165 are rotatably connected to first and second shafts 135 and 145 at the central portions 136 and 146 thereof, the inner and outer ends of the first and second shafts are free to engage the other components of the device.

As illustrated in FIGS. 3 and 5, the inner ends of first and second shafts 135 and 145 are fixably connected to first and second tilt member supports 111 and 112, respectively, which are also located on opposite sides of hollow column 105. First and second tilt member supports 111 and 112, respectively attached to the inner ends of the first and second shafts 135 and 145 on opposite sides of hollow column 105, thus facilitate the rotational movement of barrier wall 113 and barrier wall opening 114 into and out of alignment with both the passageway 61 and the hollow column opening 106. The first and second supports 111 and 112 may be connected to the inner ends of first and second shafts 135 and 145 via glue, pop rivets, screws, bolts, "key-ways," heat welds or other similar fastening methods understood by those skilled in the art.

Located at the outer ends of the first and second shafts 135 and 145 of the shaft assembly 120 illustrated in FIGS. 3 and 5 is the control device 90. The control device 90 is the mechanism by which a user imparts a rotational movement to the shaft assembly 120 to operate the gateway 63 and valve 64 of the storage and dispensing system. The control device 90 may thus include an actuator, servo, motor, knob, lever or any similar device capable of operating the gateway 63. In the embodiment shown in FIG. 5, the control device preferably includes a manually operated handle 90 connected to the outer ends of first and second shafts 135 and 145 via extensions 92 and 93.

The handle 90 is operated by a user to rotate shaft assembly 120. The rotating shaft assembly 120 thereby transmits the rotational motion to tilt member 110. Of course, the rotational motion transmitted to tilt member 110 causes the barrier wall 113 and barrier wall opening 114 to rotate into and out of alignment with the passageway 61 and the hollow column opening 106 to establish fully opened and fully closed positions of the tilt member 110, as well as any partially opened positions there between. In the preferred embodiment of the invention, the handle 90, shaft assembly 120 and tilt member 110 are spring biased in the closed position with first and second torsion springs (not shown). The torsion springs are preferably connected between the first and second shafts 135 and 145 of shaft assembly 120 and the base 100 to resist the torque of the user and to bias tilt member 110 in the closed position in relation to passageway 61. Although two torsion springs are used in the preferred embodiment, it is understood that one or any number of torsion springs could be utilized. It is also understood that one or more ribbon springs, spiral springs or other force inducing mechanisms could work as well. While the torsion springs are connected between the shaft assembly 120 and base 100 in the preferred embodiment of the invention, it is understood that the springs could also be connected between the shaft assembly 120 and hinge posts 155 and 165, the shaft assembly 120 and hollow column 105, or between the shaft assembly 120 and any rigid, stationary structure as well.

Valve 64 both enables a fluid communication between the enclosure 60 and the atmospheric modification source and separates the atmospheric modification source from the enclosure 60 before and during the time that the product is dispensed from enclosure 60. The atmospheric modification source reduces the oxygen content within the interior of enclosure 60 by creating an oxygen depleted atmosphere therein. This oxygen depleted atmosphere maintains the freshness of coffee beans stored within enclosure 60.

Figure 9:
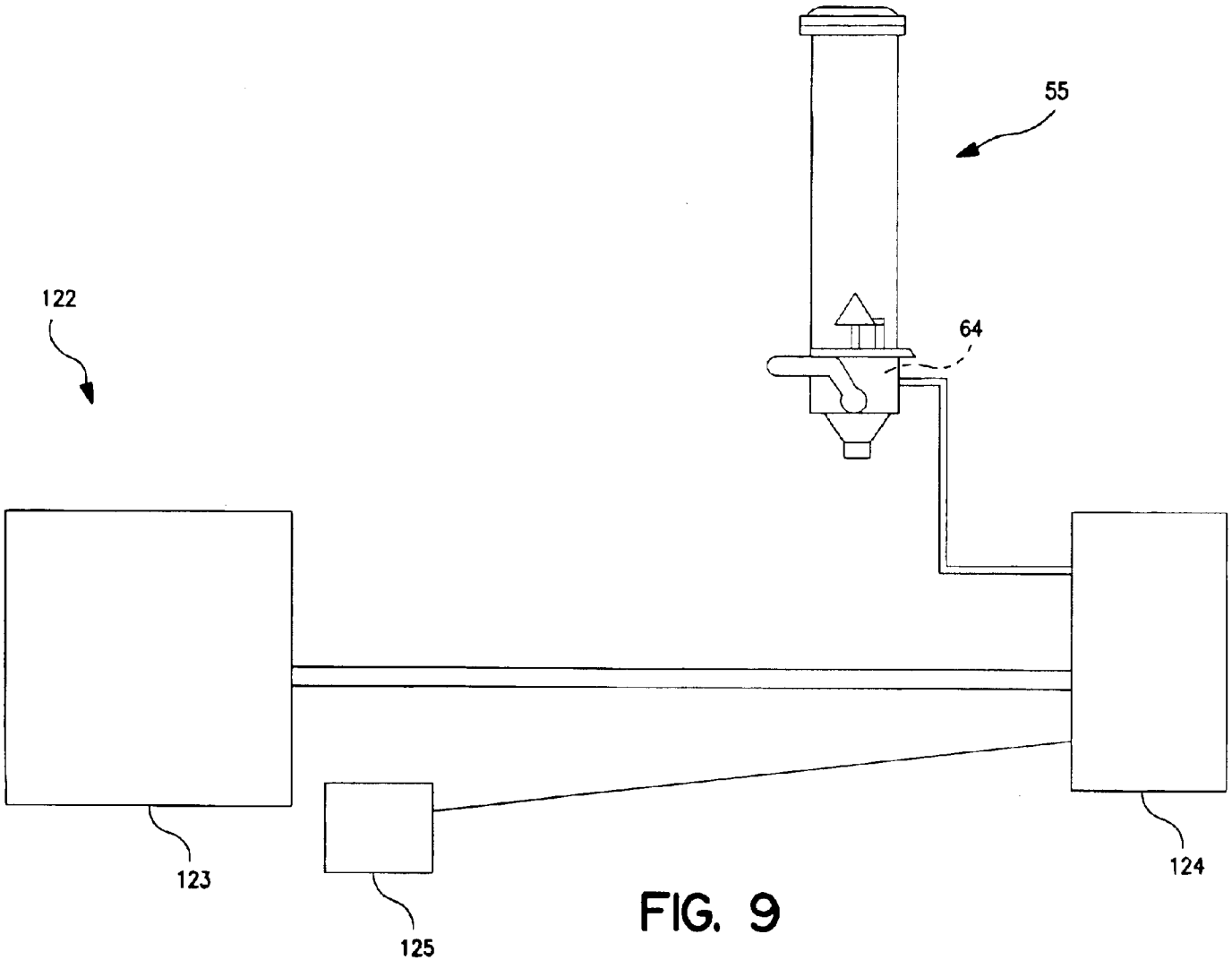
FIG. 9 is a schematic diagram of a vacuum system atmospheric modification source.

As illustrated in FIG. 9, the atmospheric modification source may include a vacuum system 122 for creating a reduced or negative pressure within the enclosure 60. The vacuum system 122 may include a vacuum pump 123 in fluid communication with a surge tank 124, with the surge tank preferably being in fluid communication with the valve 64. The surge tank 124 preferably compensates for pressure changes that may occur within the enclosure 60. A pressure switch 125 is preferably in fluid communication with the surge tank 124 to activate the vacuum pump 123 when the pressure within the surge tank and enclosure exceeds a predetermined level. However, the pressure 125 switch can also be connected to the enclosure 60, the line connecting the enclosure to the surge tank 124, or anywhere in fluid communication with the interior of the enclosure 60.

Figure 10:
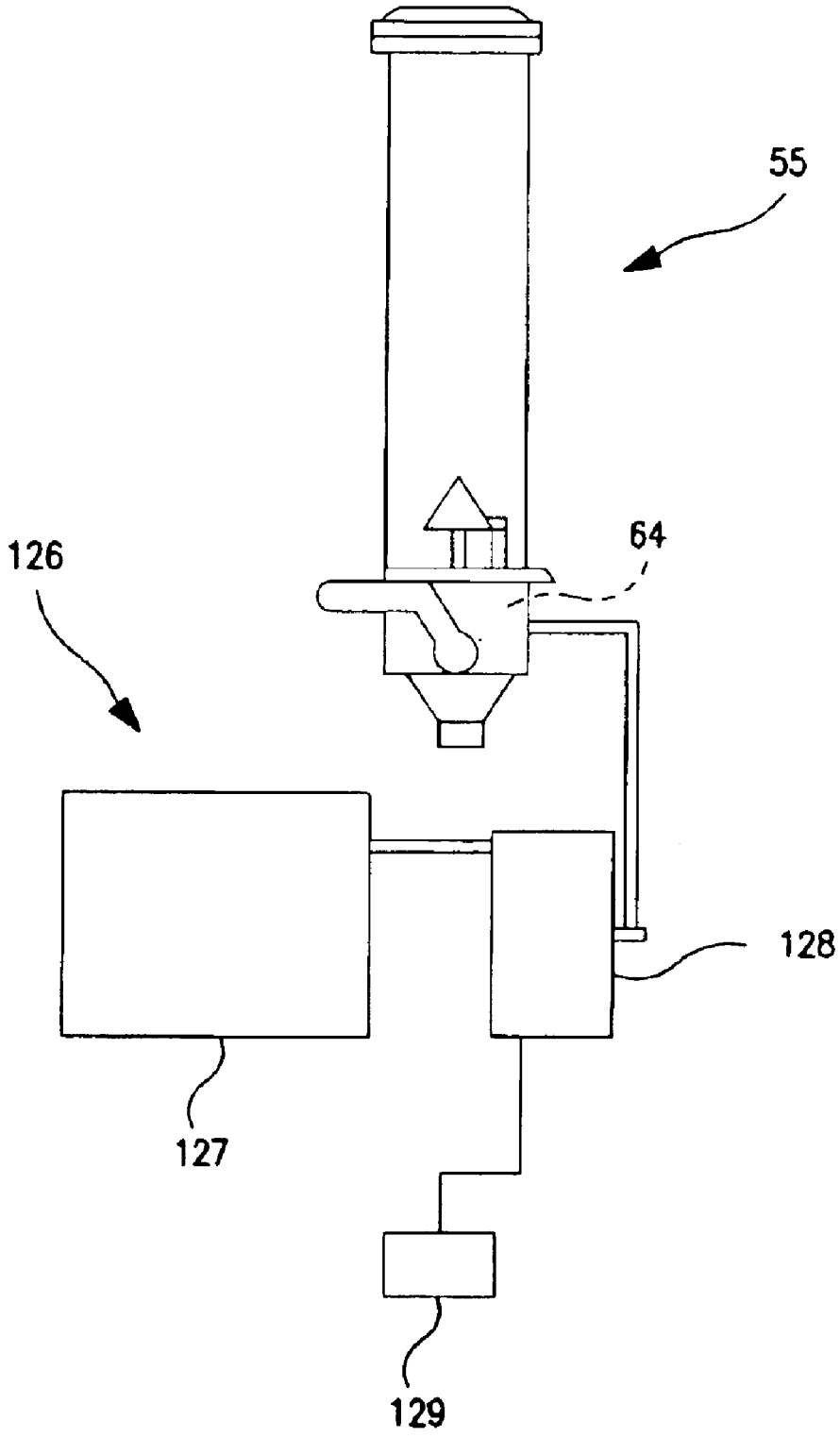
FIG. 10 is a schematic diagram of an inert gas system atmospheric modification source.

Alternatively, as illustrated in FIG. 10, the atmospheric modification source may include an inert gas insertion system 126 for creating an inert gas atmosphere within the enclosure 60. The inert gas insertion system 126 may include an inert gas source 127 in fluid communication with a gas storage and surge tank 128, with the storage and surge tank preferably being in fluid communication with the valve 64. The surge tank 128 preferably compensates for pressure changes that may occur within the enclosure 60. A pressure switch 129 is preferably in fluid communication with the storage and surge tank 128 to activate the inert gas source 127 when the pressure within the tank and enclosure reach a predetermined level. However, it is understood that the pressure 129 switch can also be connected to the enclosure 60, the line connecting the enclosure to the surge tank 128, or anywhere in fluid communication with the interior of the enclosure 60. If desired, a purge valve can also be provided on the enclosure. The inert gas source 127 may include a tank or inert gas or a gas generating device providing argon, nitrogen, carbon dioxide or any other gas understood in the art as having inert properties. The atmospheric modification systems shown in FIGS. 9 and 10 can utilized other components in place of or in addition to those illustrated therein to create the reduced oxygen atmospheric conditions within the enclosure 60.

In the preferred embodiment of the invention, valve 64 is incorporated within the second hinge post 165 and second shaft 145 of FIGS. 3 and 5. The incorporation of valve 64 into the second hinge post and shaft eliminates the need for cam mechanisms and poppet-style valves, thus simplifying the design of the system. This simplified design reduces the cost of manufacturing the system due to the reduction in parts needed to assemble it. The simplified design and reduction of parts also reduces the likelihood for the occurrence of leaks from the system.

Figure 11:
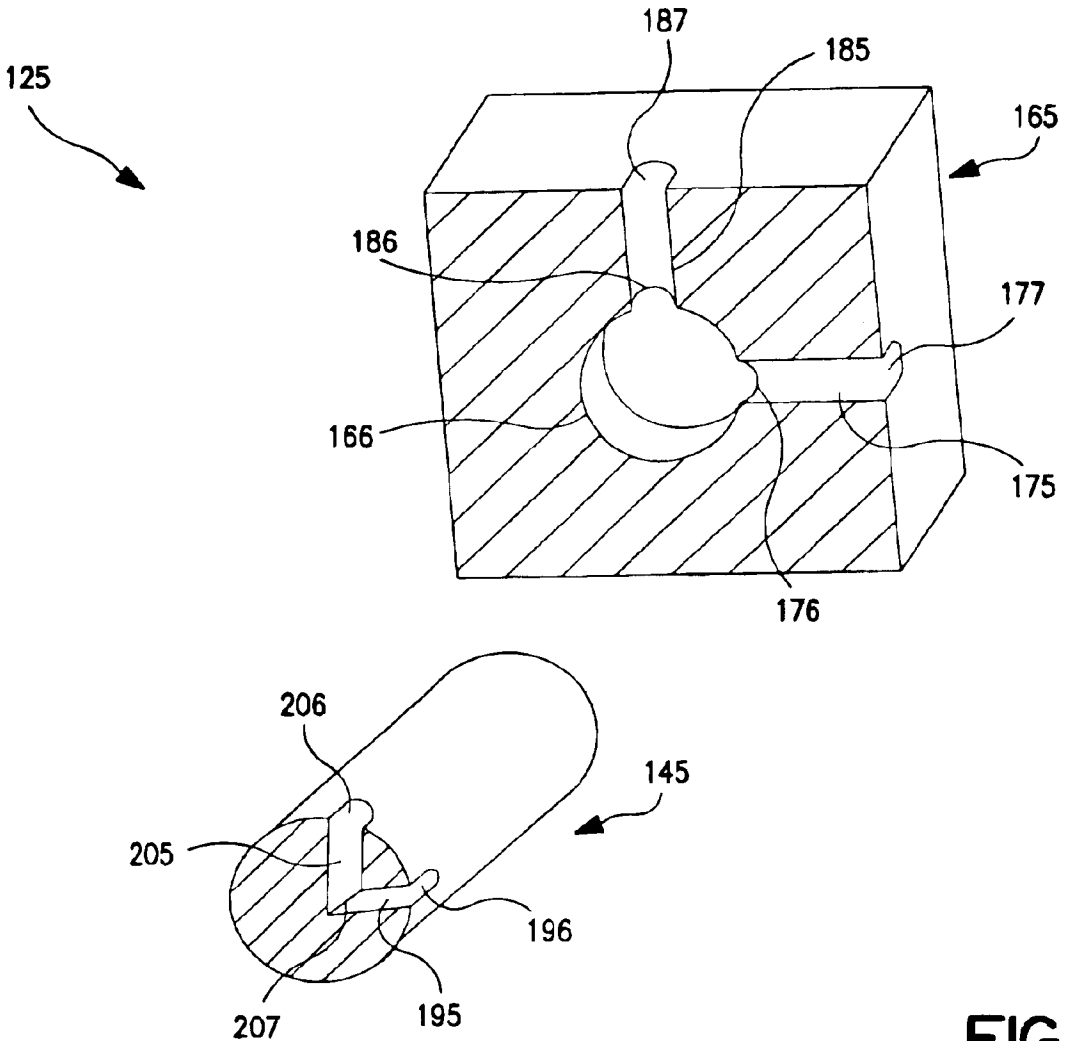
FIG. 11 is a sectional view of the second hinge post and shaft showing the components of the valve therein.

FIG. 11 show a sectional view of the second hinge post 165 and second shaft 145 of FIG. 5 to reveal the components of valve 64. Post 165 includes a sleeve 166 that accepts an insertion of shaft 145 there through to allow shaft 145 to rotatably move therein. Post 165 also includes first and second post channels 175 and 185. First and second channels 175 and 185 both intersect sleeve 166 to define first and second sleeve openings 176 and 186 and are each thus in fluid communication with sleeve 166. First and second channels 175 and 185 also intersect the exterior of post 165 to define first and second post openings 177 and 187.

As illustrated in FIG. 11, shaft 145 preferably includes first and second shaft channels 195 and 205. First and second shaft channels 195 and 205 intersect the outer periphery of shaft 145 to define shaft openings 196 and 206. First and second channels 195 and 205 also intersect each other within the interior of shaft 145 at intersection point 207 and thus are in fluid communication with one another. It is noted that the first and second sleeve openings 176 and 186, defined by first and second post channels 175 and 185, are positioned approximately 90 degrees in relation to one another. This orientation coincides with the orientation of the first and second shaft openings 196 and 206, which are also positioned approximately 90 degrees in relation to one another. While 90 degrees is the preferred angle between the first and second shaft openings 196 and 206 and the first and second sleeve openings 176 and 186, respectively, it is understood that any angle would suffice, to include 180 degrees, so long as the angle between the shaft openings and the angle between the sleeve openings coincide with one another when rotationally aligned.

Thus, when shaft 145 is inserted within post sleeve 166, shaft 145 may be rotated within sleeve 166 so that first and second shaft openings 196 and 206 are axially aligned with the first and second sleeve openings 176 and 186, respectively, to enable a fluid communication between the first and second post channels 175 and 185. It thus follows that shaft 145 may also be rotated within sleeve 166 so that first and second shaft openings 196 and 206 are not axially aligned with first and second sleeve openings 176 and 186, respectively, thus precluding a fluid communication between first and second post channels 175 and 185 and thus separating post channels 175 and 185 from one another.

Second post opening 187 is connected to the bottom of skirt 80 at one of the sockets 89, thus enabling a fluid communication between second post channel 185, socket 89, boss 91, apex 89, and the filter 87 of the dispersing mechanism 85 located within the enclosure 60 (discussed previously). The first post opening 177 is connected to the atmospheric modification source. It thus follows that when shaft 145 is rotated within sleeve 166 so that first and second shaft openings 196 and 206 are axially aligned with first and second sleeve openings 176 and 186, respectively, a fluid communication between the interior of enclosure 60 (via filter 87) and the atmospheric modification source is thus enabled via the fluid communication between channels 175 and 185. Furthermore, when shaft 145 is rotated within sleeve 166 so that first and second shaft openings 196 and 206 are not axially aligned with first and second sleeve openings 176 and 186, a fluid communication between the interior of enclosure 60 (via filter 87) and the atmospheric modification source is precluded, thus separating the interior of enclosure 60 from the source.

Both the tilt member 110 and valve 64 are each connected to the same shaft assembly 120 and thus will rotate at both a common rate and through a common rotational distance about a common axis. It is thus noted that the rotational locations of the first shaft opening 196 and first sleeve opening 176 about this common axis are directly related to the rotational location of the barrier wall opening 114 about the same axis. Furthermore, the circumferential distance between the leading edge 134 of the barrier wall 113 solid portion 133 and the barrier wall opening 114 are preferably related to the size of first shaft and sleeve opening 196 and 176.

Because of the proportion of the circumferential length of the tilt member barrier wall 113 solid portion 133 to the opening size of the first shaft and sleeve openings 196 and 176 in relation to their angular placement about the shaft assembly 120, the tilt member 110 can be rotated approximately 23 degrees from the closed stop in the embodiment shown and still remain fully closed before the valve 64 is closed to preclude a fluid communication between the enclosure and the atmospheric modification source. This relationship thus allows the shaft and sleeve openings to move out of alignment and fluid communication with one another before the barrier wall opening 114 of the tilt member 110 is rotated into alignment and fluid communication with the passageway 61.

Further rotation of the shaft assembly 120 causes the barrier wall opening 114 to begin to align with the passageway 61, thus opening enclosure 60 to the ambient, outside atmosphere at approximately 5 degrees past the closing of valve 64. Such an axial relationship between the tilt member and valve openings thus ensures that the atmospheric modification source is separated from the enclosure 60 prior to the opening of the enclosure to the ambient, outside atmosphere. The arrangement also ensures that, in the reverse sequence, the tilt member 110 is fully closed before valve 64 is opened to allow a fluid communication between the enclosure 60 and the atmospheric modification source.

While rotational angles of 23 degrees and 5 degrees are respectively utilized in the preferred embodiment of the invention to define the operable association between the tilt member 110 and valve 64, any respective angle may be utilized for each so long as the operable association between the tilt member 110 and valve 64 is maintained during the opening and closing operations of the system.

For a further understanding of the operable association existing between the tilt member 110 and valve 64, a more detailed discussion of the sequence of operation is in order. In a starting position, the tilt member 110, handle 90, and shaft assembly 120 are in a spring-biased, fully closed position while the valve 64 is in a fully open position. In this position, the coffee beans are sealed within the enclosure 60 by closed tilt member 110. At this moment, the coffee beans sealed within the enclosure 60 are also exposed to a modified atmosphere because open valve 64 has enabled a fluid communication between the enclosure 60 and the atmospheric modification source.

As the handle 90 is depressed downwardly, shaft assembly 120 begins to rotate, thus causing the barrier wall 113 solid portion 133 of the tilt member 110 to begin to rotate out of alignment with the passageway 61. After approximately 23 degrees of rotation, with tilt member 110 in the closed position because the barrier wall opening 114 has not yet aligned with the passageway and hollow column opening, valve 64 closes, thus precluding any further fluid communication between enclosure 60 and the atmospheric modification source.

As the handle 90 is further depressed, the shaft assembly 120 continues to rotate until, at approximately 5 degrees past the closing of valve 64, the barrier wall opening of tilt member 110 begins to come into alignment with the passageway 61 and hollow column opening 106. At this point, the outside atmosphere is allowed to enter the enclosure 60. However, because the closed valve 64 has separated the enclosure 60 from the atmospheric modification source, no outside atmosphere can flow backwards through the system and into the source.

As the handle 90 is still further depressed and shaft assembly 120 continues to rotate, the barrier wall opening 114 of the tilt member 110 is fully aligned with the passageway 61 and hollow column opening 106, placing tilt member 110 in the fully open position and allowing the coffee beans to fully dispense out of the enclosure 60. With tilt member 110 in the fully open position, valve 64 is in the fully closed position, still precluding a fluid communication between the enclosure and the atmospheric modification source.

After the handle 90 is released, the torsion springs connected between the shaft assembly 102 and base 100 cause the shaft assembly 120 to rotate in the opposite direction. A rotation in the opposite direction thus again closes the tilt member 110 to stop the flow of coffee beans from the enclosure 60 and thereafter opens the valve 64 to again enable a fluid communication between the enclosure 60 and the atmospheric modification source.

Although in the preferred embodiment of the invention, the operable relationship of the valve 64 with the tilt member 110 is dictated by their axial orientation with one another about the shaft assembly 120, it is understood that the operable relationship between the two may be established via micro-chip circuitry, computer software, or other similar electronic input. Such electronic input could thus command the motor, servo or other electronic control devices previously discussed that are capable of rotating the shaft assembly 120. It is also understood that other mechanical devices could be utilized to establish the operable relationship between the tilt member 110 and valve 64 as well, to include gear trains, links, belts, hydraulic or pneumatic actuators, or other similar mechanisms.

We now turn to a discussion of the cover 130 and snout 95, respectively. Referring again to FIGS. 3, 5 and 6–8, cover 130 surrounds the components of gateway 63 and valve 64 and extends downwardly from the outer periphery of the skirt 80 of the enclosure 60 to the outer periphery of the base 100. Although cover 130 is depicted in the figures as being integral with skirt 80, it is understood that the cover can also be a component separate from skirt 80 that is attachable thereto. Cover 130 preferably includes first and second cover openings 131 and 132 (FIG. 5) located on opposite sides thereof, through which the outer ends of first and second shafts 135 and 145 can protrude. Of course, handle 90 is attached to these outer shaft ends via handle extensions 92 and 93, with the handle oriented generally around cover 130. Although cover 130 is made out of plastic in the preferred embodiment of the invention, it is understood that the cover 95 may also be made out of wood, metal, or any other material having similar qualities.

The dispensing snout 95 of chute 65, as illustrated in FIGS. 3, 5 and 6–8, is attached to the base 100 and concentrically aligned with base opening 107 and hollow column 105. Although the snout 95 can be attached to the base 100, it is understood that snout 95 can be attached to the cover 130 as well. Dispensing snout 95 comprises a downwardly directed passage 96 leading to the snout opening 97 for directing coffee beans or other dispensable products out of the chute 65 of the container 55. The snout, of course, has a preferably smooth inner surface and is preferably sloped at a predetermined angle to facilitate the flow of dispensable product through snout opening 99. While snout 95 is made out of plastic in the preferred embodiment of the invention, it is understood that snout 95 may also be made out of wood, metal, or any other material having similar qualities.

Although snout 95 is depicted in FIGS. 3 and 5 as a downwardly directed passage 96 having an approximately oval cross section, it is understood that the passage 96 may have a round, rectangular, square, triangular, or any other geometrical cross section as well. Similarly, oval snout opening 97 can have a round, rectangular, square, triangular, or any other shape as well. Regardless of the shape of the opening 97, the lower end of snout 95 and opening 97 is preferably sized to fit within the rim of a coffee bean storage bag or other container to enable coffee beans to be dispensed therein.

In operation, the lid of the enclosure is removed and the dispensable product is poured therein. The lid is thereafter replaced and the atmosphere in the enclosure is then maintained by a vacuum pump, an inert gas insertion device, or some other oxygen depletion mechanism, each of which can be in fluid communication with the enclosure via the open valve. After selecting the particular dispensable product desired, the consumer depresses the handle, which causes the shaft assembly to rotate. The rotating shaft assembly causes the valve to close, thus sealing the enclosure from atmospheric modification source, and the tilt member to thereafter open, thus allowing the atmosphere into the enclosure. The coffee beans now flow over dispersing mechanism, down the skirt, through the passageway, through the tilt member barrier wall opening, into the hollow column opening, through the hollow column, out of the base opening, through the dispensing snout, and into the customer's bag or other container. After the handle is released, the torsion springs return the valve, tilt member, shaft assembly and handle to their original positions, with the tilt member being in a closed position and the valve being in an open position. With the valve in the open position, a pressure switch notes the lack of vacuum or inert gas and triggers a vacuum pump or inert gas pump such that the vacuum or inert gas conditions are recreated within the enclosure through the filter of the dispersing mechanism.

While the device has been described particularly for use with roasted whole-bean coffee, it is evident that the storage and dispensing container could be used for a variety of products where an extended shelf life is desirable. As such, the invention is capable of broad application and is readily adaptable to other fields, uses, and applications. Although the present invention and its advantages have been described in detail, it should be understood that various changes, substitutions and alterations can be made herein without departing from the spirit and scope of the invention as defined by the appended claims.

What is claimed is:

1. A storage and dispensing container comprising:

an air-tight enclosure for storing a dispensable product therein, the enclosure defining a passageway located at a bottom end;

a chute associated with the enclosure for directing a free flow of the dispensable product coming out of the enclosure through the passageway;

a gateway located between the passageway and the chute, the gateway movable between a closed position and a dispensing position, the gateway enabling the free flow of the product from the enclosure through the passageway to the chute when in the dispensing position and sealing the passageway from ambient atmosphere when in the closed position;

a valve operably associated with the gateway, the valve enabling a fluid communication between the enclosure and an atmospheric modification source when the gateway is in the closed position; and a control device operably associated with the gateway to move it between its closed position and its dispensing position.

2. The storage and dispensing container of claim 1 wherein the gateway comprises a barrier wall defining an opening and a solid portion therein and movable between closed and dispensing positions, the barrier wall opening at least partially aligned with the passageway when in the dispensing position to enable the flow of product from the enclosure and the barrier wall solid portion aligned with the passageway when in the closed position to seal the passageway.

3. The storage and dispensing container of claim 2 wherein the operable association between the valve, gateway and control device comprises a shaft assembly.

4. The storage and dispensing container of claim 3 wherein the barrier wall has the structure of a spherical segment operably connected to the shaft assembly, the barrier wall solid portion and opening located within the spherical segment and moving into and out of alignment with the passageway through a rotation of the shaft assembly.

5. The storage and dispensing container of claim 2 further including a gasket located around the passageway and contacting the barrier wall to seal the passageway when the barrier wall is in the closed position.

6. The storage and dispensing container of claim 4 further including a gasket having a ring of elastomeric material about the passageway, the ring having at least one inner circumferential ridge and at least one outer circumferential ridge in concentric relation to one another and contacting the barrier wall, the at least one outer ridge extending further towards the barrier wall than the at least one inner ridge.

7. The storage and dispensing container of claim 1 further including a sweeping assembly located within the passageway for contact with the gateway, the assembly directing the dispensable product away from an inner periphery of the passageway as the gateway moves towards the closed position.

8. The storage and dispensing container of claim 7 wherein the sweeping assembly includes at least one sweeping brush in contact with the gateway.

9. The storage and dispensing container of claim 7 wherein the sweeping assembly includes at least one wiping blade in contact with the gateway.

10. The storage and dispensing container of claim 7 wherein the sweeping assembly includes at least one sweeping brush and at least one wiping blade in contact with the gateway.

11. The storage and dispensing container of claim 5 further including a sweeping assembly located within the passageway for contact with the barrier wall, the assembly directing the dispensable product away from the gasket as the barrier wall moves towards the closed position.

12. The storage and dispensing container of claim 2 wherein the passageway has a beveled peripheral edge and the barrier wall opening has a beveled peripheral edge, the edges interacting with one another to shear the dispensable product as the barrier wall moves towards the closed position.

13. The storage and dispensing container of claim 1 further comprising a dispersing mechanism located proximal to the passageway, the dispersing mechanism diverting the dispensable product towards an outer periphery of the enclosure prior to the product entering the passageway, the dispersing mechanism having a filter in fluid communication with the valve.

14. The storage and dispensing container of claim 13 wherein the dispersing mechanism comprises an upwardly directed cone defining a hollow interior in fluid communication with the valve, the filter of the mechanism in fluid communication with the hollow interior.

15. The storage and dispensing container of claim 1 wherein the chute comprises a hollow column located proximal to the gateway and a snout located proximal to the hollow column, the dispensable product flowing through the hollow column and snout after coming out of the enclosure through the passageway.

16. The storage and dispensing container of claim 1 wherein the gateway is spring biased in the closed position.

17. The storage and dispensing container of claim 1 wherein the valve interrupts the fluid communication between the atmospheric modification source and the enclosure at least during the time the gateway is in the dispensing position.

18. The storage and dispensing container of claim 1 wherein the control device includes a manually operated handle.

19. The storage and dispensing container of claim 1 wherein the atmospheric modification source includes a vacuum system.

20. The storage and dispensing container of claim 1 wherein the atmospheric modification source includes an inert gas insertion system providing an inert gas.

21. A storage and dispensing container comprising:

an air-tight enclosure for dispensable product defining a passageway located at a bottom end;

a chute;

a tilt member located between the passageway and the chute, the tilt member defining an opening movable between a closed position sealing the passageway and a dispensing position when the opening is at least partially aligned with the passageway to enable a free flow of a dispensable product through the passageway to the chute;

a valve enabling fluid communication between the enclosure and an atmospheric modification source; and a control device operably associated with the tilt member and the valve such that when the tilt member is in the closed position, the enclosure is in fluid communication with the atmospheric modification source.

22. The storage and dispensing container of claim 21 wherein the tilt member includes a barrier wall having the structure of a hollow spherical segment.

23. The storage and dispensing container of claim 22 further including a gasket located around the passageway, the gasket contacting the barrier wall to seal the passageway when the tilt member is in the closed position.

24. The storage and dispensing container of claim 23 wherein the gasket includes a ring of elastomeric material having at least one inner ridge and at least one outer ridge, the ridges in concentric relation to one another and in contact with the barrier wall, the at least one outer ridge extending further towards the barrier wall than the at least one inner ridge.

25. The storage and dispensing system of claim 22 further including a sweeping assembly located within the passageway for contact with the barrier wall, the assembly directing the dispensable product away from an inner periphery of the passageway as the tilt member moves towards the closed position.

26. The storage and dispensing system of claim 23 further including a sweeping assembly located within the passageway for contact with the barrier wall, the assembly directing the dispensable product away from the gasket as the tilt member moves towards the closed position.

27. The storage and dispensing container of claim 21 wherein the passageway has a beveled peripheral edge that interacts with a beveled peripheral edge of the tilt member opening to shear the dispensable product as the tilt member moves towards the closed position.

28. The storage and dispensing container of claim 21 further including a dispersing mechanism located proximal to the passageway, the dispersing mechanism diverting the dispensable product towards an outer periphery of the enclosure prior to the product entering the passageway, the dispersing mechanism having a filter in fluid communication with the valve.

29. The storage and dispensing container of claim 28 wherein the dispersing mechanism includes an upwardly directed cone defining a hollow interior in fluid communication with the valve and a filter in fluid communication with the hollow interior.

30. The storage and dispensing container of claim 21 wherein the chute includes a hollow column located proximal to the gateway and a snout located proximal to the hollow column, the dispensable product flowing through the hollow column and snout after flowing through the passageway.

31. The storage and dispensing container of claim 21 wherein the operable association between the valve, tilt member and control device includes a shaft assembly.

32. The storage and dispensing container of claim 21 wherein the tilt member is spring biased in the closed position.

33. The storage and dispensing container of claim 21 wherein the valve interrupts the fluid communication between the atmospheric modification source and the enclosure at least during the time the tilt member is in the dispensing position.

34. The storage and dispensing container of claim 21 wherein the control device includes a manually operated handle.

35. The storage and dispensing container of claim 21 wherein the atmospheric modification source includes a vacuum system.

36. The storage and dispensing container of claim 21 wherein the atmospheric modification source includes an inert gas insertion system providing an inert gas.

* * * * *